US005145246A

United States Patent [19]

Ruth

[11] Patent Number: 5,145,246

[45] Date of Patent: Sep. 8, 1992

[54] ARRANGEMENT FOR COLLECTING AND EMITTING LIGHT VIA DEFINED SURFACE AREAS

[75] Inventor: Ragnar Ruth, Södertpe,acu/a/ lje, Sweden

[73] Assignee: Moagon AG, Zurich, Switzerland

[21] Appl. No.: 730,812

[22] PCT Filed: Dec. 19, 1989

[86] PCT No.: PCT/SE89/00736

§ 371 Date: Jul. 25, 1991

§ 102(e) Date: Jul. 25, 1991

[87] PCT Pub. No.: WO90/07175

PCT Pub. Date: Jun. 28, 1990

[30] Foreign Application Priority Data

Dec. 19, 1988 [SE] Sweden ..... 8804575

[51] Int. Cl.[5] ..... F21V 7/04

[52] U.S. Cl. ..... 362/31; 362/32; 40/562

[58] Field of Search ..... 362/31, 32; 40/561, 40/562

[56] References Cited

U.S. PATENT DOCUMENTS 1,893,024 1/1933 Gill ..... 40/561

4,223,374 9/1980 Kimmel ..... 362/31

*Primary Examiner*—Carroll B. Dority

[57] ABSTRACT

Arrangement for collecting and emitting light via defined surface areas (25) in order to create a slide. The arrangement consists of a number of transparent plate elements, collector plates (12–15), which are designed to receive incident light at one or more of their surfaces, collector surfaces (17–22), and to emit the received light at one or more of their other surfaces, emission surfaces (28). The collector plates consist of fluorescent material designed to convert received ultraviolet light to visible light. The arrangement comprises a plate (3) which forms a carrier for the slide which is to be presented. The plate elements (12–15) are set transverse to the carrier plate with their light-emitting surfaces (28) bearing against the rear side (29) of the carrier plate. The light-emitting surfaces (28) are situated in strip-shaped intermediate spaces between opaque parts (24) of the carrier plate.

6 Claims, 2 Drawing Sheets

ARRANGEMENT FOR COLLECTING AND EMITTING LIGHT VIA DEFINED SURFACE AREAS

TECHNICAL FIELD

The present invention relates to an arrangement for collecting and emitting light via defined surface areas in order to create a slide and comprising a number of transparent plate elements, collector plates, which are designed to receive incident light at one or more of their surfaces, collector surfaces, and to emit the received light at one or more of their other surfaces, emission surfaces, in which respect the collector plates consist of fluorescent material designed to convert received ultraviolet light to visible light.

PRIOR ART

It is previously known to use transparent plastic plates for transmission of light, for example in connection with advertisement boards, or other information boards, in which respect a particularly good effect is achieved by using fluorescent Plexiglas, which emits collected ultraviolet light in the form of visible light.

TECHNICAL PROBLEM

Certain types of information arrangements are often placed in such a position that it is impossible to provide for power supply by means of connection to the existing electricity network. Examples of such a type of information arrangement are lights, which are of the type described in Swedish Patent Application No. 8603071-5, where strip-shaped light symbols appear.

The aim of the present invention is to provide an arrangement of the type described above, which permits a very great light exchange by using both sunlight and artificial light as the light source.

INVENTION

The said aim is achieved by means of an arrangement according to the invention, which is characterized in that the arrangement includes a plate, which forms a carrier for the slide which is to be presented, and in that the said plate elements are set transverse to the said carrier plate with their light-emitting surfaces bearing against the rear side of the carrier plate, and in that the said light-emitting surfaces are situated in strip-shaped intermediate spaces between opaque parts of the carrier plate.

DESCRIPTION OF FIGURES

The invention will be described in greater detail below on the basis of an exemplary embodiment and with reference to the attached drawings, in which FIG. 2 shows a front view of the arrangement, while

PREFERRED EMBODIMENT

Figure 1:
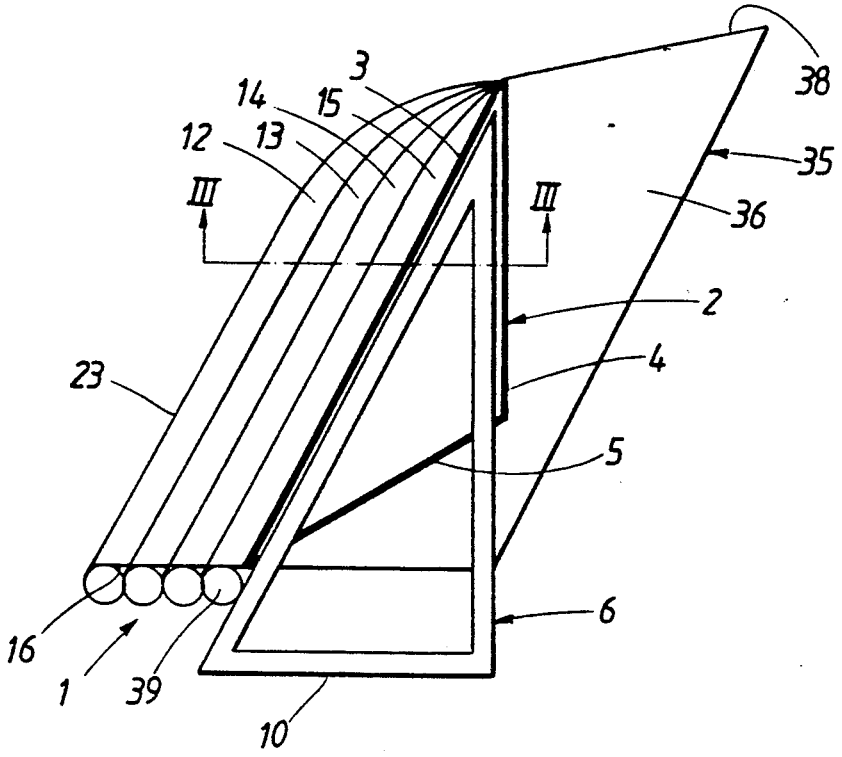
FIG. 1 shows schematically a partially broken side view of the arrangement according to the invention.
Figure 2:
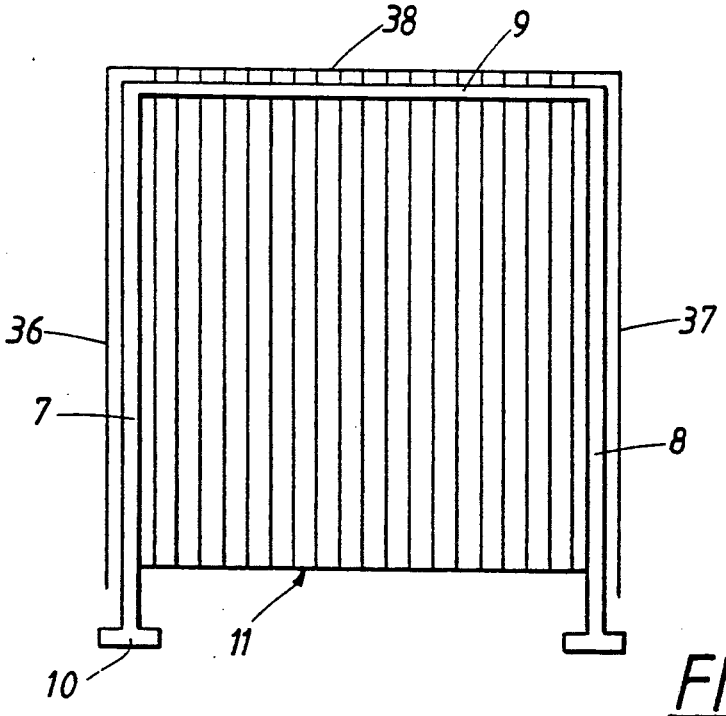

The arrangement shown by way of example in the drawings consists of a light, which uses the moiré technique in order to indicate to the viewer, by means of a pattern, where the former is situated relative to a plane of symmetry. The position of the viewer is indicated by means of a pattern varying in relation to the position, which is described in greater detail in, for example, the abovementioned Swedish Patent Application No. 8603071-5. In order to form this pattern, a light source 1 is required and at least two screen units set at an angle relative to each other, a front screen unit 2 and a rear screen unit 3. In the example shown, the front screen unit is divided up into two screen parts 4, 5 which are set at an angle to each other, as shown in FIG. 1. The screen units 3, 4, 5 are supported by a frame 6 consisting of, for example, two side pieces 7, 8 and a crosspiece 9 and a lower support piece 10, the frame exposing maximally the information surface 11 formed by the screen units, on which surface 11 information symbols appear.

According to the invention a number of light-collector plates 12, 13, 14, 15 are connected to the rear screen element 3 and extend over the entire height of the screen unit 3 and advantageously have different widths, a central collector plate 12 having the greatest width, and the width of the other plates decreasing successively in the direction towards the sides. The collector plates 12–15 have downward-directed end surfaces 16 which form collector surfaces for picking up incident light together with the mutually parallel side surfaces 17, 18, 19, 20, 21, 22 of the collector plates, see FIG. 3. The rear screen unit 3 is also designed as a collector plate and is, like the other collector plates 12–15, of a special type of transparent plastic, advantageously fluorescent transparent acrylic plastic, such as Plexiglas from Röhm or LISA from Bayer.

Figure 3:
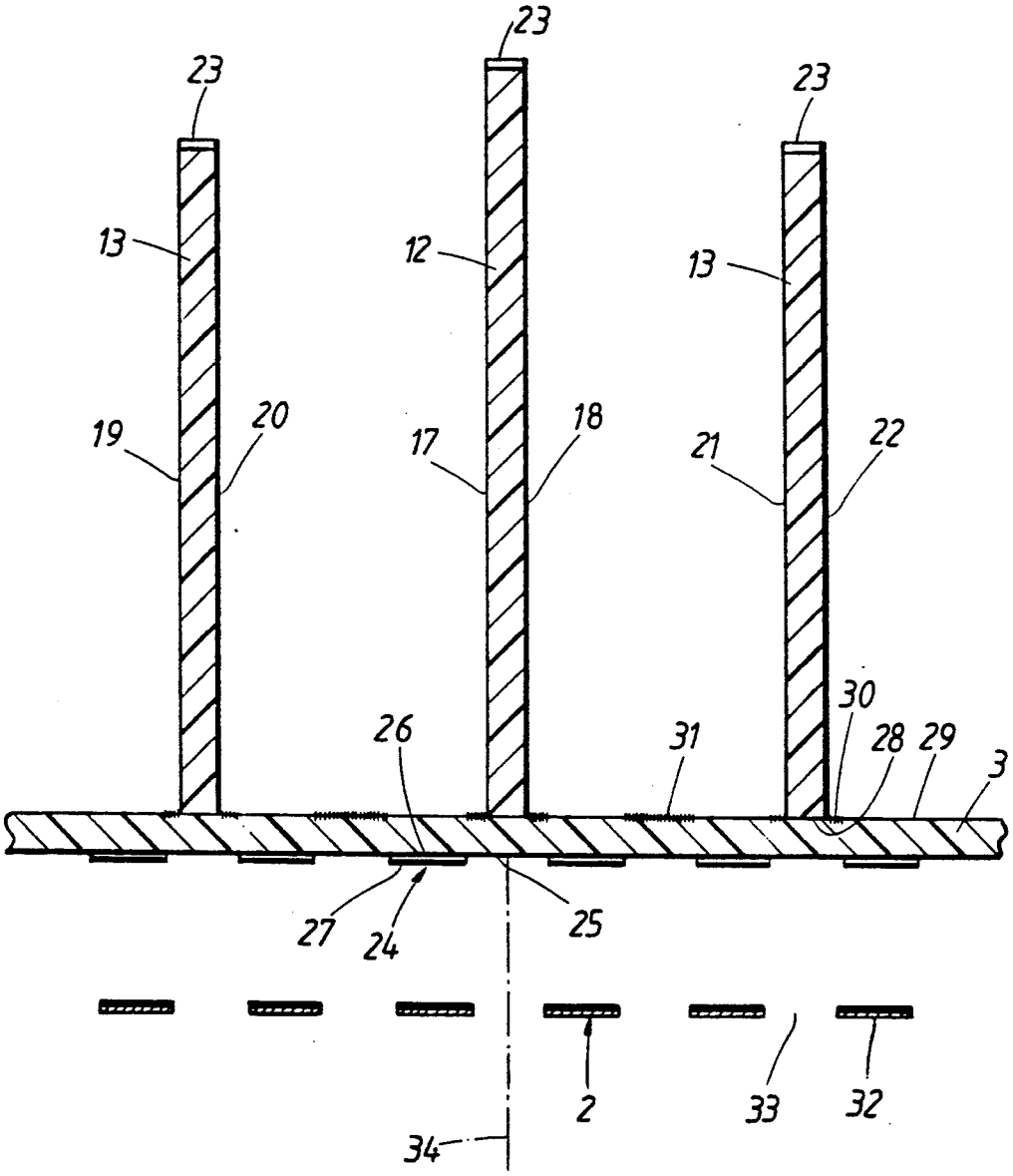
FIG. 3 shows, on a greatly enlarged scale, a broken part of a vertical section through the arrangement according to the invention along the line III—III in FIG. 1.

As emerges best from FIG. 3, the rear end surfaces 23 of the collector plates are sealed by means of sealing with, for example, an opaque foil, advantageously an inward-reflecting foil, so that light is not transmitted in an undesired direction. The foil can be white for example. The collector plates are advantageously attached firmly to the rear screen plate, for example by means of gluing with acrylic adhesive, so that a maximal light transmission is achieved over to and through the rear screen plate 3. The latter has a number of opaque strips 24, positioned with intermediate spaces so that transparent, strip-shaped spaces 25 are formed. The opaque strips 24 consist advantageously of a first layer 26 with good reflecting power, for example a white strip layer, aluminized layer or the like, covered with a dark, preferably black strip layer 27 facing towards the front screen unit. The collector plates 12–15 are positioned in such a way that their front end surfaces 28, which are glued to the rear screen plate 3, are situated in line with at least some of the strip-shaped spaces 25 between the opaque strips 24. In the example shown, the collector plates are positioned in line with every second transparent space 25, but they can in principle be positioned in line with each intermediate space or every third intermediate space etc. In order to achieve a maximal light exchange, the collector plates should not be positioned too close to each other, but instead it must be possible for light to be admitted to the collector surfaces 17–22 between the plates. If it is possible to select collector plates with the same thickness as the width of the transparent intermediate spaces, a high-quality distinct slide will be obtained, but in a case, as shown in FIG. 3, where the collector plates have a smaller thickness than the width of the transparent intermediate spaces, a relatively uniformly illuminated image can also be obtained by treating that surface 29 of the rear screen plate 3 facing rearwards towards the collector plates, for example by etching on one side or on both sides of each collector plate over a treated surface 30 such that the treated surface, together with the thickness of the collector plate, corresponds to the width of the respective transparent intermediate space. The treatment is of such a type that a "damage" or disturbance is created in the rear screen plate, in which respect light emission can take place.

As shown in the example, further surfaces 31 can be treated in order to produce the said disturbance in the smooth rear side of the screen plate, such as elongate strips in line with the intermediate spaces, where there are no collector plates. In this way an increased light emission is obtained through the rear screen plate in line with the transparent intermediate spaces.

The front screen element 2 in the example shown is not designed as a homogeneous plate, but is made up of a grid of separate, opaque strips 32 of, for example, light metal, which are thus self-supporting and free-standing and have between them intermediate spaces 33 such that the opaque strips 32 are arranged in a predetermined distribution relationship relative to the distribution relationship of the opaque strips 24 in the rear screen on the rear screen plate 3. By means of a suitably adapted distribution relationship, the moiré pattern mentioned above and known per se is achieved, which indicates the position of a viewer placed at a great distance relative to a plane of symmetry, for example a plane at right angles to the plane of the paper in FIG. 3 along the line 34.

As emerges best from FIG. 1, the arrangement is covered at least partially by a casing 35 which, in the example shown, consists of two gable pieces 36, 37 and a cross-piece 38. The casing extends rearwards to the rear screen plate 3 and projects in such a way that light incident from the front is blocked out maximally, in order to give as clearly readable a slide as possible. In the example shown, the collector plates 12–15 are not screened off by the casing, but are open from all directions for receiving incident sunlight. Furthermore, the light source 1 in the example shown consists of a number of (in the example shown 4) elongate fluorescent tubes 39 which are suitably supported on a bracket (not shown) on the frame 6 and extend in a transverse direction under the lower end surfaces 16 of the collector plates. With the construction described above, a particularly high level of light exchange is achieved both as regards the use of light from the sun and from the artificial light source in the form of fluorescent tubes. The arrangement is self-regulating insofar as strong sunlight, which requires a strong slide for maximal contrast, gives the desired effect with a strong slide by means of the fact that greater light incidence gives greater light emission in the defined surface areas which, in the example shown, consist of the strip-shaped intermediate spaces 25 between the opaque strips 24. The light incidence thus takes place, as regards sunlight, essentially incident on the principal surfaces of the collector plates, that is to say the side surfaces 19, 22 and also incident on the rear side of the screen plate 3, in which respect the latter can advantageously be sealed at its edge surfaces in conformity with the rear edge surfaces 23 of the other collector plates. The light emission takes place at the non-sealed edge surfaces of the collector plates, that is to say the edge surfaces 28, which are positioned in line with at least some of the strip-shaped intermediate spaces 25. A light emission also takes place at the damaged surfaces 30, 31, which are arranged in the screen plate 3. The artificial light supplements or replaces normal light, when the latter does not attain a sufficient light intensity, which can be detected by means of a photocell or be controlled quite simply by a timer, which lights the fluorescent tubes 39 before darkness sets in. The collector plates are in this respect irradiated again at their main surfaces 19–22, but also at their lower end surfaces 16 which serve as collector surfaces. A viewer to the front of the arrangement according to the invention thus sees all day round a slide on the information board 11 which, in the example shown, appears as a strip-shaped pattern, which is angled off to an arrow-shaped pattern when the viewer deviates from the line of symmetry 34. This so-called moiré pattern will not be described in detail here, since it belongs to the prior art.

The invention is not limited to the exemplary embodiment described above and shown in the drawings, but can be varied within the scope of the following patent claims. For example, it is not necessary per se for the arrangement according to the invention to be used to produce a moiré pattern, but instead an information pattern of another type can be created. For example, the collector plates do not per se have to be plane, but instead can be curved so as to form defined surface areas at their edge surfaces so that particular symbols are created. The arrangement can be used in many types of installations where access to conventional energy sources is limited; for example, the arrangement can also be used on mobile units. It is also conceivable for collector plates to be arranged for each strip-shaped intermediate space 25. The front screen unit can likewise be constructed as a plate with opaque strip-shaped patterns applied.

I claim:

1. Arrangement for collecting and emitting light via defined surface areas (25) in order to create a slide and comprising a number of transparent plate elements, collector plates (12–15), which are designed to receive incident light at one or more of their surfaces, collector surfaces (17–22), and to emit the received light at one or more of their other surfaces, emission surfaces (28), in which respect the collector plates consist of fluorescent material designed to convert received ultraviolet light to visible light, characterized in that the arrangement comprises a plate (3) which forms a carrier for the slide which is to be presented, and in that the said plate elements (12–15) are set transverse to the said carrier plate with their light-emitting surfaces (28) bearing against the rear side (29) of the carrier plate, and in that the said light-emitting surfaces (28) are situated in strip-shaped intermediate spaces between opaque parts (24) of the carrier plate.

2. Arrangement according to patent claim 1, characterized in that the carrier plate (3) also consists of a collector plate made of a fluorescent material.

3. Arrangement according to patent claim 1, characterized in that the collector plates (12–15) have different widths relative to each other, with the width decreasing from the central collector plate or plates towards the two sides of the arrangement.

4. Arrangement according to patent claim 1, characterized in that an artificial light source (11) is situated at the collector plates (12–15).

5. Arrangement according to patent claim 1, in which the said carrier plate (3) forms a line screen of opaque strips and strip-shaped intermediate spaces, which screen is designed to cooperate with another front-lying line screen of opaque strips and strip-shaped intermediate spaces in order to form a moiré pattern, characterized in that the light-emitting surfaces (28) of the collector plates (11–15) are situated in line with at least some of the strip-shaped intermediate spaces (25) in the carrier plate (3).

6. Arrangement according to patent claim 5, characterized in that the rear edge surfaces (5) of the collector plates (12–15) facing away from the carrier plate (3) are sealed.

* * * * *

UNITED STATES PATENT AND TRADEMARK OFFICE

CERTIFICATE OF CORRECTION

PATENT NO. : 5,145,246

DATED : September 8, 1992

INVENTOR(S) : Ragnar Ruth

It is certified that error appears in the above-identified patent and that said Letters Patent is hereby corrected as shown below:

On the title page: Item [75] Inventor should read:

--Ragnar Ruth, Södertälje, Sweden--

Signed and Sealed this

Twenty-first Day of September, 1993

Bruce Lehman

*Attest:*

BRUCE LEHMAN

*Attesting Officer*

*Commissioner of Patents and Trademarks*